US006672493B1

(12) United States Patent
Fair et al.

(10) Patent No.: US 6,672,493 B1
(45) Date of Patent: Jan. 6, 2004

(54) INFANT CARRIER AND SHOULDER HARNESS THEREFOR

(75) Inventors: Paul Fair, Denver, CO (US); Cynthia R. Nelson, Longmont, CO (US)

(73) Assignee: Evenflo Company, Inc., Vandalia, OH (US)

( * ) Notice: Subject to any disclaimer, the term of this patent is extended or adjusted under 35 U.S.C. 154(b) by 0 days.

(21) Appl. No.: 10/238,554

(22) Filed: Sep. 10, 2002

(51) Int. Cl.[7] ..... A61G 1/00
(52) U.S. Cl. ..... 224/160; 224/259; 224/627
(58) Field of Search ..... 224/160, 161, 224/259, 627

(56) References Cited

U.S. PATENT DOCUMENTS

| | | | | | |
|---|---|---|---|---|---|
| 770,761 | A | | 9/1904 | Lemly | |
| 1,871,223 | A | | 8/1932 | Reese | |
| 2,943,775 | A | | 7/1960 | Mack | |
| 3,964,654 | A | | 6/1976 | Wittenberger | |
| 4,428,514 | A | | 1/1984 | Elf | 224/151 |
| 4,640,317 | A | | 2/1987 | Chardon et al. | 139/431 |
| 4,941,604 | A | | 7/1990 | Nagareda | 224/160 |
| 4,949,888 | A | * | 8/1990 | May | 224/627 |
| 4,986,458 | A | | 1/1991 | Linday | 224/160 |
| 5,016,797 | A | | 5/1991 | Rowledge | 224/257 |
| 5,064,108 | A | | 11/1991 | Headley | 224/253 |
| 5,205,450 | A | | 4/1993 | Derosier | 224/161 |
| 5,205,451 | A | | 4/1993 | Manzer | 224/161 |
| 5,490,620 | A | | 2/1996 | Bergqvist | 224/160 |
| 5,639,004 | A | * | 6/1997 | Carlton et al. | 224/579 |
| 5,678,739 | A | | 10/1997 | Darling et al. | 224/160 |
| 5,732,861 | A | | 3/1998 | Jakobson | 224/160 |
| 5,927,576 | A | * | 7/1999 | Nielsen | 224/161 |
| 6,152,338 | A | * | 11/2000 | Smith | 224/259 |
| 6,152,342 | A | * | 11/2000 | Suk | 224/627 |
| 6,311,884 | B1 | | 11/2001 | Johnson | 224/627 |
| 6,409,060 | B2 | * | 6/2002 | Donine | 224/160 |

* cited by examiner

*Primary Examiner*—Gary E. Elkins
(74) *Attorney, Agent, or Firm*—Taft, Stettinius & Hollister LLP

(57) ABSTRACT

A shoulder harness includes left and right shoulder straps having ends attachable to a front-infant-carrier pouch. The left shoulder strap has a lengthwise-extending first slot defined between lengthwise-extending first and second portions of the left shoulder strap. The right shoulder strap has a lengthwise-extending second slot defined between lengthwise-extending third and fourth portions of the right shoulder strap. The first portion extends over one of the third and fourth portions, extends through the second slot, and extends under the other of the third and fourth portions. The second portion extends under the one of the third and fourth portions, extends through the second slot, and extends over the other of the third and fourth portions. A front infant carrier includes the pouch and the shoulder harness with the strap ends attached to the pouch.

20 Claims, 3 Drawing Sheets

INFANT CARRIER AND SHOULDER HARNESS THEREFOR

TECHNICAL FIELD

The present invention relates generally to infant carriers, and more particularly to a front infant carrier and to a shoulder harness for a front infant carrier.

BACKGROUND OF THE INVENTION

Conventional infant carriers are used by adults to carry babies, infants, and young children. Known infant carriers include back infant carriers and front infant carriers. Back infant carriers carry the infant in an infant-carrier pouch on the back of an adult, and front infant carriers carry the infant in an infant-carrier pouch on the front of the adult. Some pouches allow the infant to be carried facing forward (with the adult considered to be facing forward), and some pouches allow the infant to be carried facing rearward (with the adult considered to be facing forward).

Conventional front infant carriers include those having a shoulder harness including left and right shoulder straps which go over, respectively, the left and right shoulders of the adult who is carrying the infant. Some infant carriers have an additional strap in the form of a waist belt. The shoulder straps have ends which are attached to the infant-carrier pouch. In one known arrangement, the left shoulder strap extends from the upper left side to the lower right side of the pouch, the right shoulder strap extends from the upper right side to the lower left side of the pouch, and the one strap crosses over the other strap at the back of the adult wearing the front infant carrier. The shoulder straps are adjusted by changing a snap-attachment location of the shoulder straps to the pouch or by changing the working length of the shoulder straps using a buckle with some wearers doing this adjustment when the infant is in the pouch.

What is needed is an improved front infant carrier and an improved shoulder harness for a front infant carrier.

SUMMARY OF THE INVENTION

A first expression of an embodiment of the invention is for a shoulder harness for a front infant carrier. The shoulder harness includes an infant-carrier left shoulder strap having first and second ends attachable to a front-infant-carrier pouch. The shoulder harness also includes an infant-carrier right shoulder strap having third and fourth ends attachable to the pouch. The left shoulder strap has a lengthwise-extending first slot defined between lengthwise-extending first and second portions of the left shoulder strap. The right shoulder strap has a lengthwise-extending second slot defined between lengthwise-extending third and fourth portions of the right shoulder strap. The first portion extends over one of the third and fourth portions, extends through the second slot, and extends under the other of the third and fourth portions. The second portion extends under the one of the third and fourth portions, extends through the second slot, and extends over the other of the third and fourth portions.

A second expression of an embodiment of the invention is for a front infant carrier. The front infant carrier includes a front-infant-carrier pouch. The front infant carrier also includes the shoulder harness described in the previous paragraph, wherein the first, second, third, and fourth ends are attached to the pouch.

Several benefits and advantages are derived from one or more of the expressions of an embodiment of the invention. In one example, having the shoulder straps crossover on the back of an adult wearing the front infant carrier with each strap split in a lengthwise direction at the crossover and with the split portions interwoven in a basket-weave manner allows the shoulder straps to be adjusted on the adult without requiring the inconvenience of buckles to adjust the working length of the straps and without requiring the inconvenience of snaps to adjust the attachment of the strap ends to the front-infant-carrier pouch. The shoulder straps permit easy adjustment for various shoulder widths and torso lengths of the adult wearer. The shoulder straps permit such adjustment before the infant is placed in the pouch, with the later placement of the infant in the pouch adding weight on the straps to tightly hold the straps in their adjusted position. This eliminates the obvious safety concern of adjusting buckles, or re-positioning the location attachments of snaps, with the infant already placed in the pouch.

DESCRIPTION OF THE PREFERRED EMBODIMENTS

Figure 1:
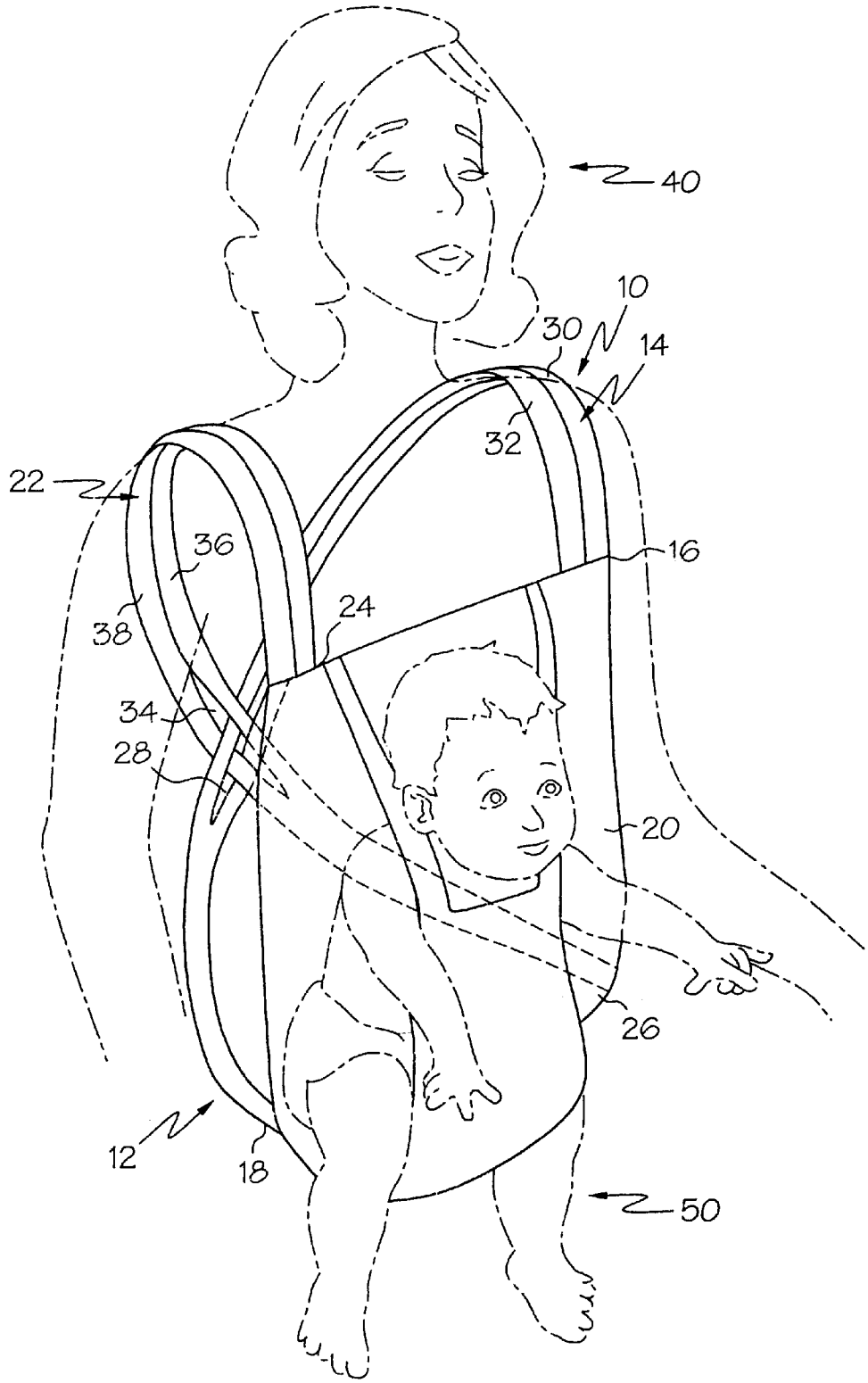
FIG. 1 is a perspective view of an embodiment of the invention showing a shoulder harness and a pouch for a front infant carrier with the shoulder harness being worn by an adult and with an infant placed in the pouch.
Figure 2:
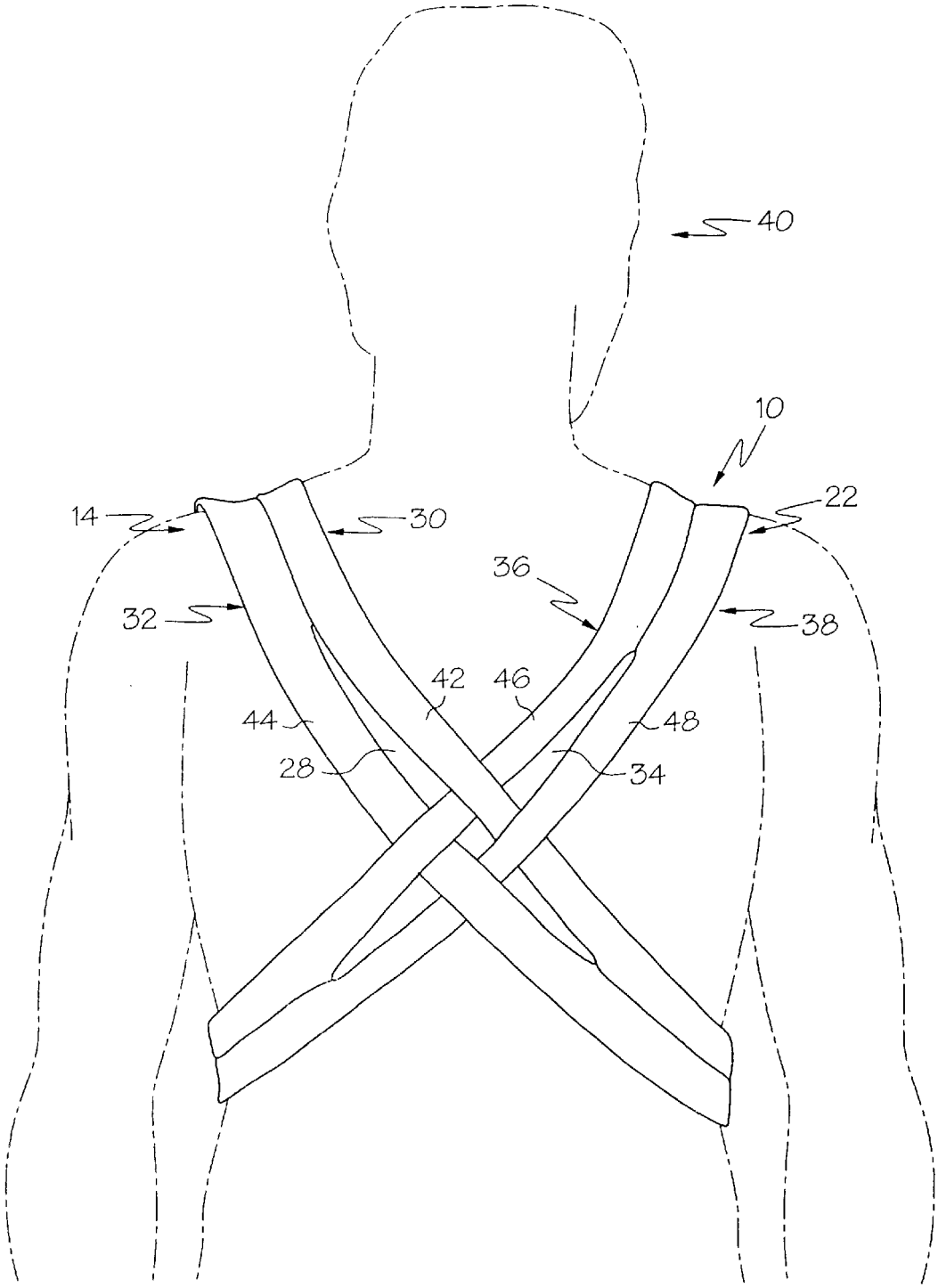
FIG. 2 is a back elevational view of the shoulder harness of FIG. 1 showing the shoulder straps adjusted more widely apart on the shoulders of the adult.
Figure 3:
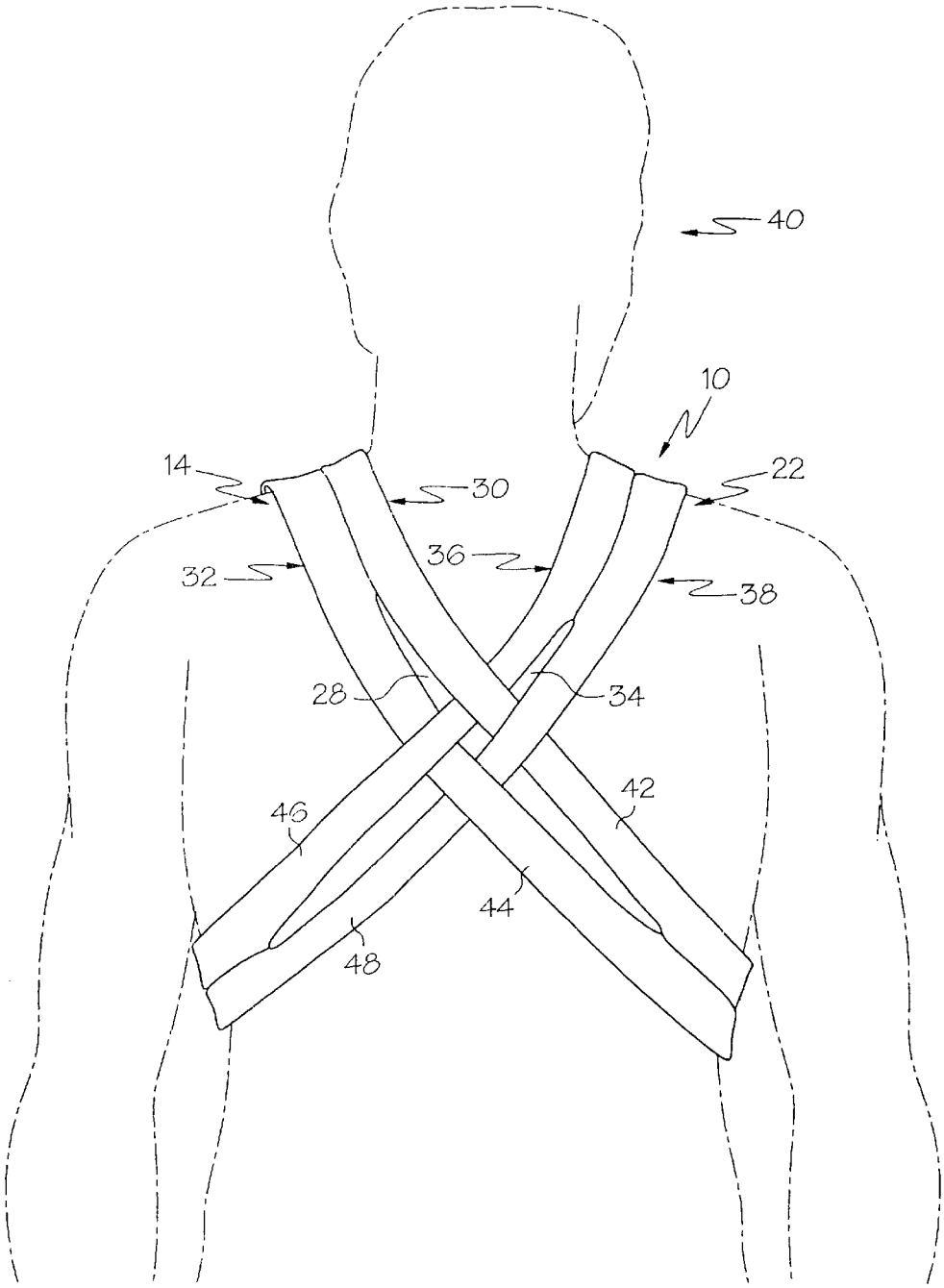
FIG. 3 is a back elevational view of the shoulder harness of FIG. 1 showing the shoulder straps adjusted less widely apart on the shoulders of the adult.

Referring now to the drawings, FIGS. 1–3 illustrate an embodiment of the present invention. A first expression of the embodiment shown in the figures is for a shoulder harness 10 for a front infant carrier 12. The term "infant" includes a baby, an infant, and a young child. The shoulder harness 10 includes an infant-carrier left shoulder strap 14 having first and second ends 16 and 18 attachable to a front-infant-carrier pouch 20. A left shoulder strap is a shoulder strap that goes over the left shoulder of a wearer. The shoulder harness 10 also includes an infant-carrier right shoulder strap 22 having third and fourth ends 24 and 26 attachable to the pouch 20. A right shoulder strap is a shoulder strap that goes over the right shoulder of a wearer. The left shoulder strap 14 has a lengthwise-extending first slot 28 defined between lengthwise-extending first and second portions 30 and 32 of the left shoulder strap 14. By "lengthwise-extending" means extending in a lengthwise direction for at least a portion of the length. The right shoulder strap 22 has a lengthwise-extending second slot 34 defined between lengthwise-extending third and fourth portions 36 and 38 of the right shoulder strap 22. The first portion 30 extends over one of the third and fourth portions 36 and 38, extends through the second slot 34, and extends under the other of the third and fourth portions 36 and 38. The second portion 32 extends under the one of the third and fourth portions 36 and 38, extends through the second slot 34, and extends over the other of the third and fourth portions 36 and 38.

It is noted that, in the embodiment shown in FIGS. 2 and 3, the first portion 30 extends over the third portion 36 and under the fourth portion 38, and the second portion 32 extends under the third portion 36 and over the fourth portion 38. In another embodiment, not shown, the first portion 30 extends under the third portion 36 and over the fourth portion 38, and the second portion 32 extends over the third portion 36 and under the fourth portion 38. In one example, such strap embodiments have the shoulder straps crossover on the back of an adult 40 wearing the front infant carrier 12 with each strap 14 and 22 split in a lengthwise direction at the crossover and with the split portions interwoven in a plain-weave manner. In one modification, each strap has three or more interwoven split portions.

In one variation of the first embodiment, the left shoulder strap 14 includes first and second lengthwise-extending segments 42 and 44, wherein the first lengthwise extending segment 42 includes the first portion 30, wherein the second lengthwise-extending segment 44 includes the second portion 32, and wherein the first and second lengthwise-extending segments 42 and 44 are lengthwise attached together except at the first and second portions. By "lengthwise attached together" is meant attached together substantially along the total length. In the same or a different variation, the right shoulder strap 22 includes third and fourth lengthwise-extending segments 46 and 48, wherein the third lengthwise extending segment 46 includes the third portion 36, wherein the fourth lengthwise-extending segment 48 includes the fourth portion 38, and wherein the third and fourth lengthwise-extending segments 46 and 48 are lengthwise attached together except at the third and fourth portions 36 and 38. In a different variation, the first and second lengthwise-extending segments are not attached together between their ends, and the third and fourth lengthwise-extending segments are not attached together between their ends.

In one modification, the first, second, third, and fourth portions 30, 32, 36, and 38 are substantially identical in width. In the same or a different modification, the first and second slots 28 and 34 are substantially identical in length. In one example, the right shoulder strap 22 is a mirror image of the left shoulder strap 14.

In the same or a different modification, the first end 16 is attachable to a left-side portion of the pouch 20, the second end 18 is attachable to a right-side portion of the pouch 20, the third end 24 is attachable to the right-side portion of the pouch 20, and the fourth end 26 is attachable to the left-side portion of the pouch 20. In one variation, the first end 16 is attachable to an upper left-side portion of the pouch 20, the second end 18 is attachable to a lower right-side portion of the pouch 20, the third end 24 is attachable to an upper right-side portion of the pouch 20, and the fourth end 26 is attachable to a lower left-side portion of the pouch 20.

In one application, the first and second slots 28 and 34 are disposed entirely along the back of an adult 40 wearing the shoulder harness 10. In this application, the first and second slots 28 and 34 do not extend to the front of the adult 40. In one implementation, the first, second, third, and fourth ends 16, 18, 24, and 26 are fixedly attached to the pouch 20. By "fixedly" is meant that an end cannot be removed from the pouch without damaging the end or the pouch or both. In a different implementation, one or more of the first, second, third, and fourth ends 16, 18, 24, and 26 are removably attached to the pouch 20, as is within the level of skill of the artisan. By "removably" is meant that an end can be removed from the pouch without damaging the end and without damaging the pouch.

In one design, the first slot 28 extends substantially the entire length of the left shoulder strap 14. In this design, the second slot 34 extends substantially the entire length of the right shoulder strap 22. In another design, the first slot 28 extends less than half the length of the left shoulder strap 14, and the second slot 34 extends less than half the length of the right shoulder strap 22.

In one choice of materials, the pouch comprises a fabric. In one variation, the fabric of the pouch surrounds a plastic stiffener. In the same or a different variation, the fabric surrounds padding. In the same or a different choice of materials, the straps comprise fabric or webbing or both and, in one variation, are padded. The particular design of the pouch and the particular attachment locations of the strap ends to the pouch do not form a part of the invention, are not discussed further herein, and are within the design capabilities of those of ordinary skill of the art.

A second expression of the embodiment shown in the figures is for a front infant carrier 12. The front infant carrier 12 includes the front-infant-carrier pouch 20 and the shoulder harness 10 as described in the previous first expression, with the first, second, third, and fourth ends 16, 18, 24, and 26 attached to the pouch 20, and including as options for the second expression any one or more optional examples, variations, etc. of the previous first expression. As previously mentioned, the front infant carrier 12 carries the infant 50 in the pouch 20 on the front of the adult 40. In one example the infant 50 faces forward, and in another example the infant 50 faces rearward.

A first method of the invention is for an adult 40 to carry an infant 50 using the front infant carrier 12 described in the previous second expression including as options for the first method any optional examples, variations, etc of the second expression. The first method includes steps a) through c) Step a) includes placing the front infant carrier 12 on the adult 40 without an infant 50 being placed in the pouch 20 wherein the pouch 20 is disposed at the front of the adult 40 and the first and second slots 28 and 34 are disposed at the back of the adult 40. Step b) includes then adjusting the position of the left and right shoulder straps 14 and 22 on the shoulders of the adult 40 without changing the working length of the left and right shoulder straps 14 and 22 and without changing the attachment of the first, second, third, and fourth ends 16, 18, 24, and 26 to the pouch 20. Step c) includes then placing the infant 50 in the pouch 20.

In one performance of the first method, step b) includes adjusting the position of the left and right shoulder straps 14 and 22 for the shoulder width of the adult 40. In the same or a different performance of the first method, step b) includes adjusting the position of the left and right shoulder straps 14 and 22 for the torso length of the adult 40.

Several benefits and advantages are derived from one or more of the expressions of an embodiment of the invention. In one example, having the shoulder straps crossover on the back of an adult wearing the front infant carrier with each strap split in a lengthwise direction at the crossover and with the split portions interwoven in a basket-weave manner allows the shoulder straps to be adjusted on the adult without requiring the inconvenience of buckles to adjust the working length of the straps and without requiring the inconvenience of snaps to adjust the attachment of the strap ends to the front-infant-carrier pouch. The shoulder straps permit easy adjustment for various shoulder widths and torso lengths of the adult wearer. The shoulder straps permit such adjustment before the infant is placed in the pouch, with the later placement of the infant in the pouch adding weight on the straps to tightly hold the straps in their adjusted position. This eliminates the obvious safety concern of adjusting buckles, or re-positioning the location attachments of snaps, with the infant already placed in the pouch.

The foregoing description of several expressions of an embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A shoulder harness for a front infant carrier comprising:

a) an infant-carrier left shoulder strap having first and second ends attachable to a front-infant-carrier pouch; and b) an infant-carrier right shoulder strap having third and fourth ends attachable to the pouch;

wherein the left shoulder strap has a lengthwise-extending first slot defined between lengthwise-extending first and second portions of the left shoulder strap, wherein the right shoulder strap has a lengthwise-extending second slot defined between lengthwise-extending third and fourth portions of the right shoulder strap, wherein the first portion extends over one of the third and fourth portions, extends through the second slot, and extends under the other of the third and fourth portions, and wherein the second portion extends under the one of the third and fourth portions, extends through the second slot, and extends over the other of the third and fourth portions.

2. The shoulder harness of claim 1, wherein the left shoulder strap includes first and second lengthwise-extending segments, wherein the first lengthwise-extending segment includes the first portion, wherein the second lengthwise-extending segment includes the second portion, and wherein the first and second lengthwise-extending segments are lengthwise attached together except at the first and second portions.

3. The shoulder harness of claim 2, wherein the right shoulder strap includes third and fourth lengthwise-extending segments, wherein the third lengthwise extending segment includes the third portion, wherein the fourth lengthwise-extending segment includes the fourth portion, and wherein the third and fourth lengthwise-extending segments are lengthwise attached together except at the third and fourth portions.

4. The shoulder harness of claim 3, wherein the first, second, third, and fourth portions are substantially identical in width.

5. The shoulder harness of claim 4, wherein the first and second slots are substantially identical in length.

6. The shoulder harness of claim 5, wherein the first and second slots are disposed entirely along the back of an adult wearing the shoulder harness.

7. The shoulder harness of claim 1, wherein the first end is attachable to a left-side portion of the pouch, the second end is attachable to a right-side portion of the pouch, the third end is attachable to the right-side portion, and the fourth end is attachable to the left-side portion.

8. The shoulder harness of claim 1, wherein the first slot extends substantially the entire length of the left shoulder strap, and wherein the second slot extends substantially the entire length of the right shoulder strap.

9. A front infant carrier comprising a front-infant-carrier pouch and a shoulder harness, wherein the shoulder harness includes:

a) an infant-carrier left shoulder strap having first and second ends attached to a front-infant-carrier pouch; and b) an infant-carrier right shoulder strap having third and fourth ends attached to the pouch;

wherein the left shoulder strap has a lengthwise-extending first slot defined between lengthwise-extending first and second portions of the left shoulder strap, wherein the right shoulder strap has a lengthwise-extending second slot defined between lengthwise-extending third and fourth portions of the right shoulder strap, wherein the first portion extends over one of the third and fourth portions, extends through the second slot, and extends under the other of the third and fourth portions, and wherein the second portion extends under the one of the third and fourth portions, extends through the second slot, and extends over the other of the third and fourth portions.

10. The front infant carrier of claim 9, wherein the left shoulder strap includes first and second lengthwise-extending segments, wherein the first lengthwise extending segment includes the first portion, wherein the second lengthwise-extending segment includes the second portion, and wherein the first and second lengthwise-extending segments are lengthwise attached together except at the first and second portions.

11. The front infant carrier of claim 10, wherein the right shoulder strap includes third and fourth lengthwise-extending segments, wherein the third lengthwise extending segment includes the third portion, wherein the fourth lengthwise-extending segment includes the fourth portion, and wherein the third and fourth lengthwise-extending segments are lengthwise attached together except at the third and fourth portions.

12. The front infant carrier of claim 11, wherein the first, second, third, and fourth portions are substantially identical in width.

13. The front infant carrier of claim 12, wherein the first and second slots are substantially identical in length.

14. The front infant carrier of claim 13, wherein the first and second slots are disposed entirely along the back of an adult wearing the shoulder harness.

15. The front infant carrier of claim 9, wherein the first end is attachable to a left-side portion of the pouch, the second end is attachable to a right-side portion of the pouch, the third end is attachable to the right-side portion, and the fourth end is attachable to the left-side portion.

16. The front infant carrier of claim 9, wherein the first slot extends substantially the entire length of the left shoulder strap, and wherein the second slot extends substantially the entire length of the right shoulder strap.

17. A method for an adult to carry an infant using the front infant carrier of claim 9 comprising the steps of:

a) placing the front infant carrier on the adult without an infant being placed in the pouch wherein the pouch is disposed at the front of the adult and the first and second slots are disposed at the back of the adult;

b) after step a), adjusting the position of the left and right shoulder straps on the shoulders of the adult without changing the working length of the left and right shoulder straps and without changing the attachment of the first, second, third, and fourth ends to the front-infant-carrier pouch; and c) after step a), placing the infant in the pouch.

18. The method of claim 17, wherein step b) includes adjusting the position of the left and right shoulder straps for the shoulder width of the adult.

19. The method of claim 18, wherein step b) includes adjusting the position of the left and right shoulder straps for the torso length of the adult.

20. The method of claim 17, wherein step b) includes adjusting the position of the left and right shoulder straps for the torso length of the adult.

* * * * *